US008387700B2

(12) United States Patent
Hern

(10) Patent No.: US 8,387,700 B2
(45) Date of Patent: Mar. 5, 2013

(54) WELLBORE DEBRIS CLEANOUT ASSEMBLY AND METHOD TO REMOVE DEBRIS FROM A DEBRIS CATCHER

(75) Inventor: Gregory L. Hern, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 421 days.

(21) Appl. No.: 12/789,914

(22) Filed: May 28, 2010

(65) Prior Publication Data

US 2011/0290334 A1 Dec. 1, 2011

(51) Int. Cl.
*E21B 37/08* (2006.01)
*E21B 31/08* (2006.01)

(52) U.S. Cl. ..... 166/311; 166/99

(58) Field of Classification Search ..... 166/311, 166/70, 170, 99, 56; 137/15.04, 238
See application file for complete search history.

(56) References Cited

U.S. PATENT DOCUMENTS

| | | | | |
|---|---|---|---|---|
| 3,107,742 | A * | 10/1963 | Woods et al. | 175/309 |
| 3,118,510 | A * | 1/1964 | Woods et al. | 175/308 |
| 4,190,113 | A | 2/1980 | Harrison | 166/311 |
| 6,250,387 | B1 | 6/2001 | Carmichael et al. | 166/311 |
| 6,607,031 | B2 | 8/2003 | Lynde et al. | |
| 6,745,839 | B1 * | 6/2004 | Simpson | 166/311 |
| 2008/0053651 | A1 | 3/2008 | Hern | 166/173 |

* cited by examiner

*Primary Examiner* — Brad Harcourt
(74) *Attorney, Agent, or Firm* — Shawn Hunter

(57) ABSTRACT

A cleanout assembly for removal of debris from a debris chamber in a wellbore cleaning tool. The cleanout assembly includes a mandrel, a boot radially surrounding the mandrel and a debris chamber defined radially between the mandrel and the boot. The boot has one or more windows therein to permit debris to be cleaned out of the debris chamber. A cover is disposed within the debris chamber and is movable within the debris chamber between a first position, wherein the one or more windows are blocked by the cover, and a second position, wherein the one or more windows are not blocked by the cover

19 Claims, 7 Drawing Sheets

WELLBORE DEBRIS CLEANOUT ASSEMBLY AND METHOD TO REMOVE DEBRIS FROM A DEBRIS CATCHER

BACKGROUND OF THE INVENTION

1. Field of the Invention

The invention relates generally to systems and methods for cleaning debris from a wellbore debris catcher. In some aspects, the invention relates to the design of a cleanout arrangement for a debris catcher device.

2. Description of the Related Art

Wellbore cleaning reduces the risk of encountering complications when installing equipment to complete a well. Wellbore cleaning devices are known that incorporate brushes, scrapers or other cleaning blades.

Tools that collect removed debris within a debris chamber during a wellbore cleanup operation provide a means to confirm that there is a limited amount of debris remaining in the wellbore. Being able to quickly confirm the amount of debris that has been collected in a debris chamber saves the operator rig time. Debris catcher arrangements are described in U.S. Pat. No. 6,607,031 issued to Lynde et al. and U.S. Pat. No. 6,250,387 issued to Carmichael et al.

SUMMARY OF THE INVENTION

The invention provides an improved cleanout arrangement for a cleaning tool having a debris catcher assembly with a one-piece mandrel and a surrounding boot. The cleaning tool preferably has a brush-type cleanup assembly to help remove debris from the interior surface of a surrounding tubular and direct the removed debris into a debris chamber inside the tool. The debris chamber is preferably defined between the mandrel and the boot. An exterior fluid flow path is preferably defined upon the outer radial surface of the boot. The cleanout assembly includes a window that is formed in the surrounding boot and which can be selectively opened and closed by shifting a cover that is retained between the boot and the mandrel. The cover is secured to the mandrel by set screws.

In operation, the cleaning tool is incorporated into a tool string and disposed into a surrounding tubular to be cleaned. The windows of the cleanout arrangement are closed during this time. The tool string is reciprocated, and the cleaning tool scrapes away debris. As the cleaning tool is removed from the tubular, fluid circulation ports open on the cleanup assembly and permit removed debris to enter and be captured within the debris chamber. Fluid is drained away from the captured debris by a filter screen. After the cleaning tool is removed from the surrounding tubular, the windows of the cleanout assembly are moved to their open configuration by rotating the boot with respect to the mandrel, using hoses and other tools to remove debris from below the cover, removing set screws from the cover to detach the cover from the mandrel, and moving the cover axially so that the cover is below the windows in the boot. Debris can then be removed from the debris chamber through the windows in the boot using hoses and other tools.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
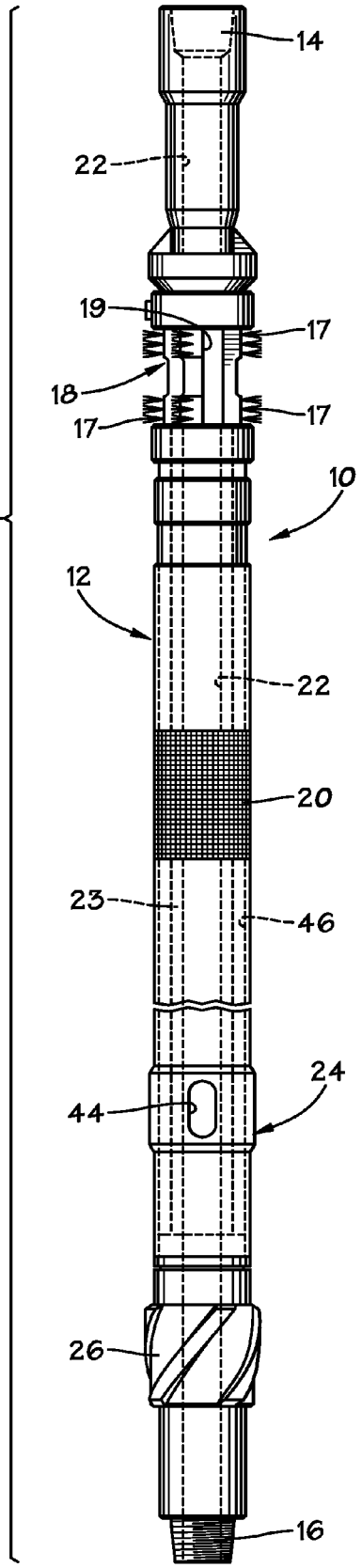
FIG. 1 is a side view of an exemplary wellbore cleaning tool which incorporates a cleanout assembly constructed in accordance with the present invention.
Figure 2:
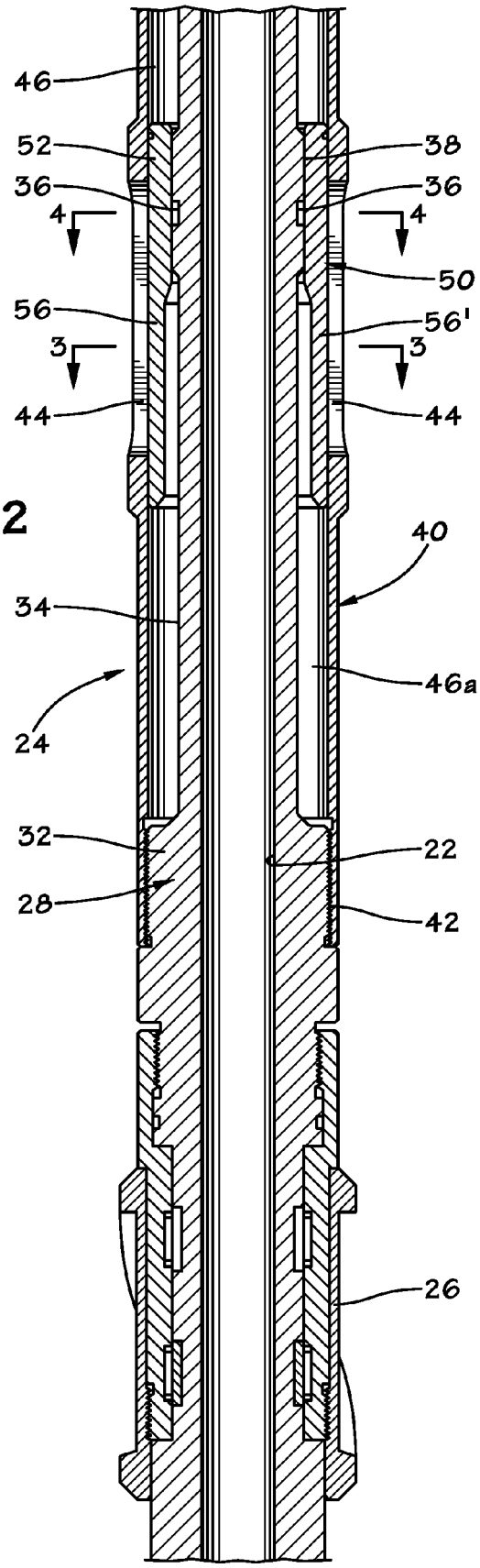
FIG. 2 is a side, cross-sectional view of an exemplary cleanout assembly shown in FIG. 1 which is constructed in accordance with the present invention and shown with the clean-out window in a closed position.

FIGS. 1 and 2 illustrate an exemplary cleaning tool 10 which can be used to clean and remove debris from the interior surface of casings or other tubular members. In most respects, the cleaning tool 10 may be generally of the type exemplified as the Multi-Task Wellbore Filter™ which is available commercially from Baker Oil Tools of Houston, Tex. The tool 10 includes a tool body 12 with an upper axial end 14 and a lower axial end 16 which are provided with threaded connections to permit the tool 10 to be incorporated into a complete tool string (not shown) in a manner known in the art. A cleanup assembly 18 is carried on the tool body 12. The cleanup assembly 18 includes brushes 17 that are cleaning members useful for the removal of debris that is coated on the interior of a surrounding tubular member. The cleanup assembly 18 also includes ports 19 that are preferably closed during run-in and operation, but opened upon withdrawal from a surrounding tubular. Preferably, the cleanup assembly 18 is a device of the type described in U.S. Pat. No. 7,562,703, issued to Palmer et al. U.S. Pat. No. 7,562,703 is owned by the assignee of the present invention and is hereby incorporated by reference in its entirety.

As can be seen with reference to FIG. 1, the tool body 12 of the cleaning tool 10 defines a central axial flow bore 22. An annular debris chamber 46 radially surrounds the central flow bore 22 and is separated from the central flow bore 22 by annular wall 23. Debris-laden fluid enters tool 10 via the ports 19 of the cleanup assembly 18. Filter screen 20 allows fluid to flow out of tool 10 while retaining debris in the debris chamber 46. An exemplary cleanout arrangement or assembly 24 is depicted generally proximate the lower axial end 16 of the tool 10. A stabilizer 26, of a type well known in the art, is also preferably carried on the tool body 12 below the cleanout assembly 24.

In operation, the cleaning tool 10 is incorporated into a tool string and disposed into a tubular member to be cleaned. The tool string is reciprocated to cause the brush portions of the cleanup tool 18 to scrape debris from the interior of the surrounding tubular. Fluid carrying debris is drawn into debris chamber 46 via ports 19 in the cleanup tool 18, as described in U.S. Pat. No. 7,562,703.

Construction and operation of the cleanout assembly 24 is best understood with reference to FIGS. 2-8. The exemplary cleanout assembly 24 includes a central mandrel 28 which encloses the central flow bore 22 along its length. Preferably, the mandrel 28 is a single piece and not formed of multiple sections or components that are affixed to one another. The exemplary mandrel 28 presents a radially enlarged portion 32 and a radially reduced portion 34. A plurality of indentations 36 (best seen in FIG. 4) are formed in a radially enlarged flange 38 in the radially reduced portion 34.

Figure 4:
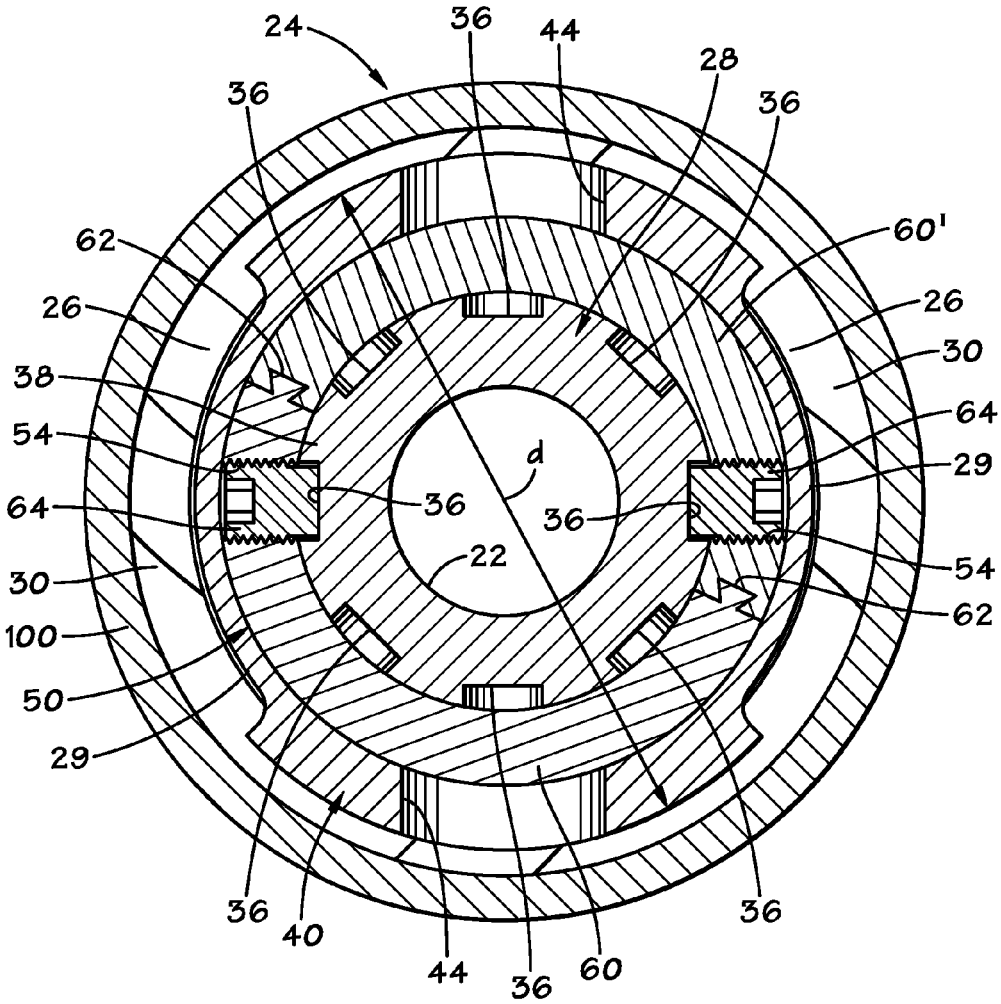
FIG. 4 is an axial cross-sectional view taken along lines 4-4 in FIG. 2.
Figure 5:
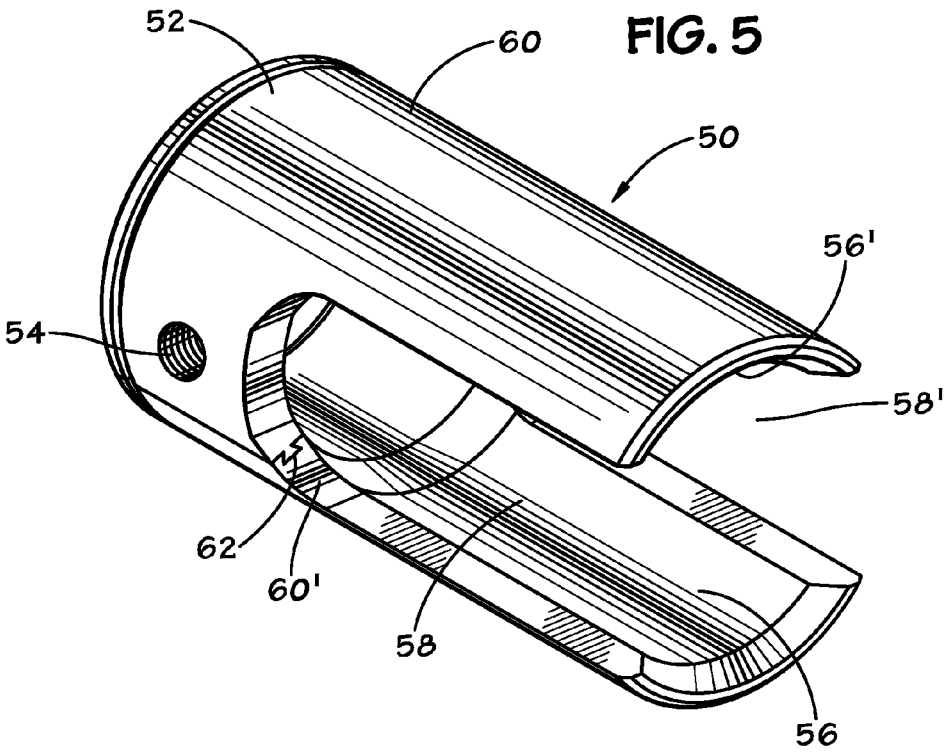
FIG. 5 is an external, isometric view of an exemplary cover used in the assembly shown in FIGS. 1-4 apart from the other components of the assembly.
Figure 6:
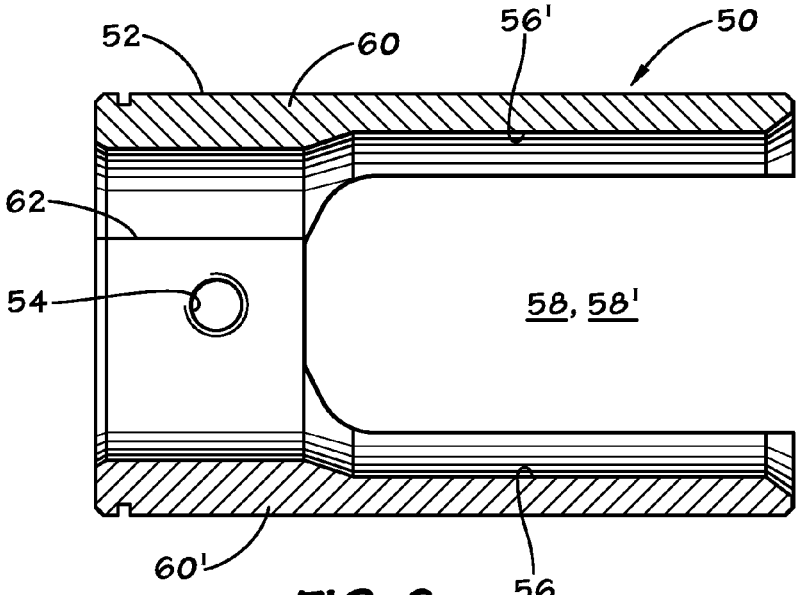
FIG. 6 is a side, cross-sectional view of the cover shown in FIG. 5.

A generally cylindrical boot 40 radially surrounds the central mandrel 28 and is preferably affixed to the mandrel 28 by a threaded connection 42. The boot 40 includes a plurality of side windows 44 that are disposed through the boot 40. In the depicted embodiment, there are two such windows 44. However, there may be more or fewer than two such windows 44. The annular debris chamber 46 is defined radially between the radially reduced portion 34 and the boot 40. The boot 40 is sized so that the outer diameter of the boot 40, at the windows 44, is proximate the interior diameter of a surrounding tubular to be cleaned. FIG. 4 depicts the cleanout assembly 24 within a surrounding tubular member 100. It can be seen there that the boot 40 presents an outer diameter "d" that preferably approximates drift diameter. Reduced diameter cut-out portions 29 are formed in the outer diameter d of the boot 40 and provide flow passages 30 that are defined between the boot 40 and the surrounding tubular 100. The flow passages 30 allow fluid to flow past the cleanout assembly 24 despite the boot 40 being at or near drift diameter. Having windows 44 in the boot 40 to allow for removal of debris from debris chamber 46 reduces the tensile and torsion strength of the boot. The presence of the flow paths 29 permits the boot 40 of the tool 10 to be at or near drift diameter around windows 44, which increases the torsion and tensile strength of the boot 40. The increased thickness of the boot 40 at windows 44 compensates for the material removed to create windows 44.

A moveable cover 50 is located within the debris chamber 46. The upper end of the cover 50 essentially forms the lower axial end of the debris chamber 46. When the cover 50 is in place within the debris chamber 46, a lower chamber **46*a* is defined below the cover 50. Ordinarily, a significant amount of debris will not enter the lower chamber 46*a*, since the cover 50 will physically block this. An exemplary cover 50 is depicted apart from the other components of the cleanout assembly 24 in FIGS. 5 and 6. Generally, the cover 50 includes an annular base ring portion 52. Threaded holes 54 are formed through the base ring portion 52. Two blocking portions 56, 56' preferably extend axially from the ring portion 52. The blocking portions 56 are separated from each other by openings 58, 58'. It is currently preferred that the cover 50 is formed of two semi-cylindrical portions 60, 60' that are secured to one another by tongue-in-groove arrangements 62 (see FIGS. 4, 5 and 6**).

Figure 3:
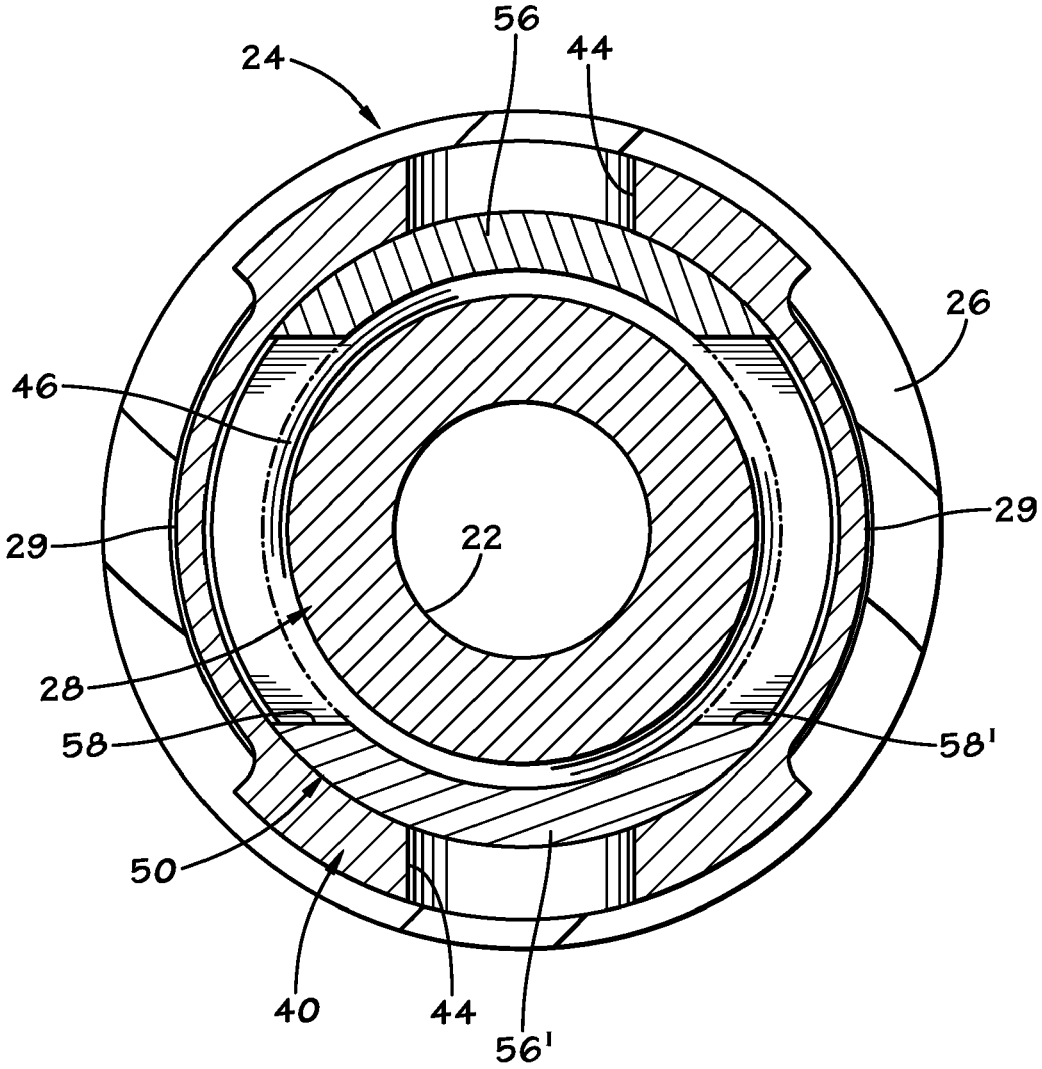
FIG. 3 is an axial cross-sectional view of the assembly shown in FIG. 2, taken along lines 3-3 in FIG. 2.

FIGS. 2, 3 and 4 depict the cleanout assembly 24 in a closed condition wherein the windows 44 of the boot 40 are closed off by the blocking portions 56, 56' of the cover 50. The cover 50 is retained in this position by screws 64 which reside within the threaded holes 54 and an adjacent indentation 36. It is also noted that, when the windows of the boot 40 are aligned with the blocking portions 56, 56', the screws 64 are covered by the boot 40 and cannot be removed from the threaded holes 54.

Figure 7:
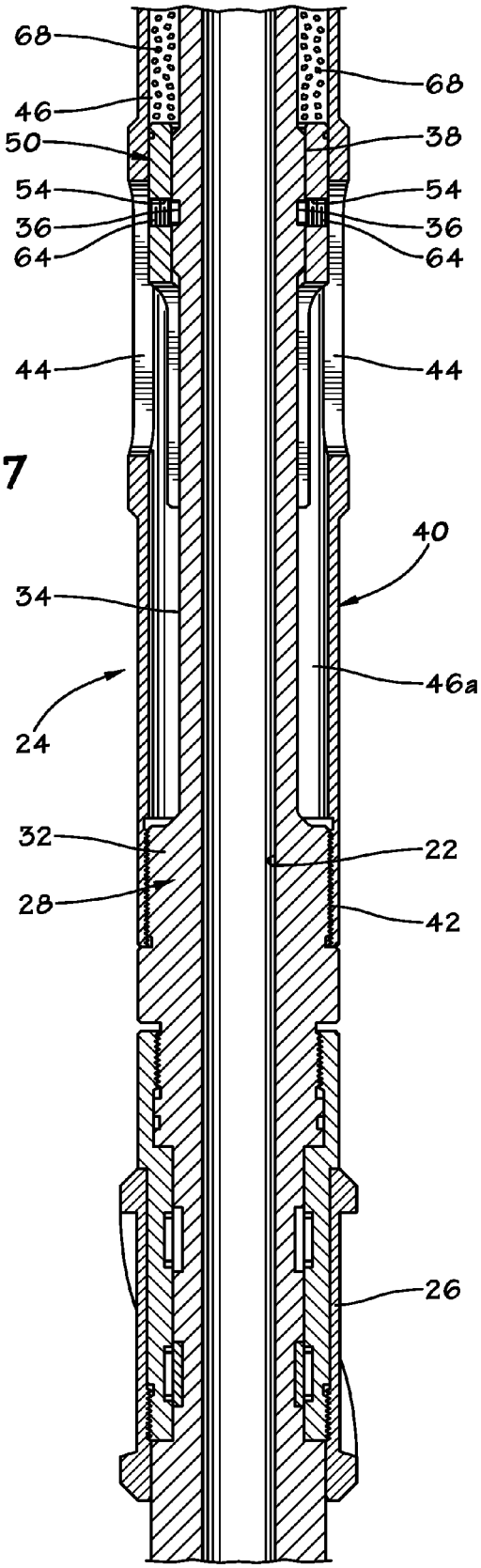
FIG. 7 is a side, cross-sectional view of the cleaning tool shown in FIGS. 1-4, now with the clean-out window in an open position.
Figure 8:
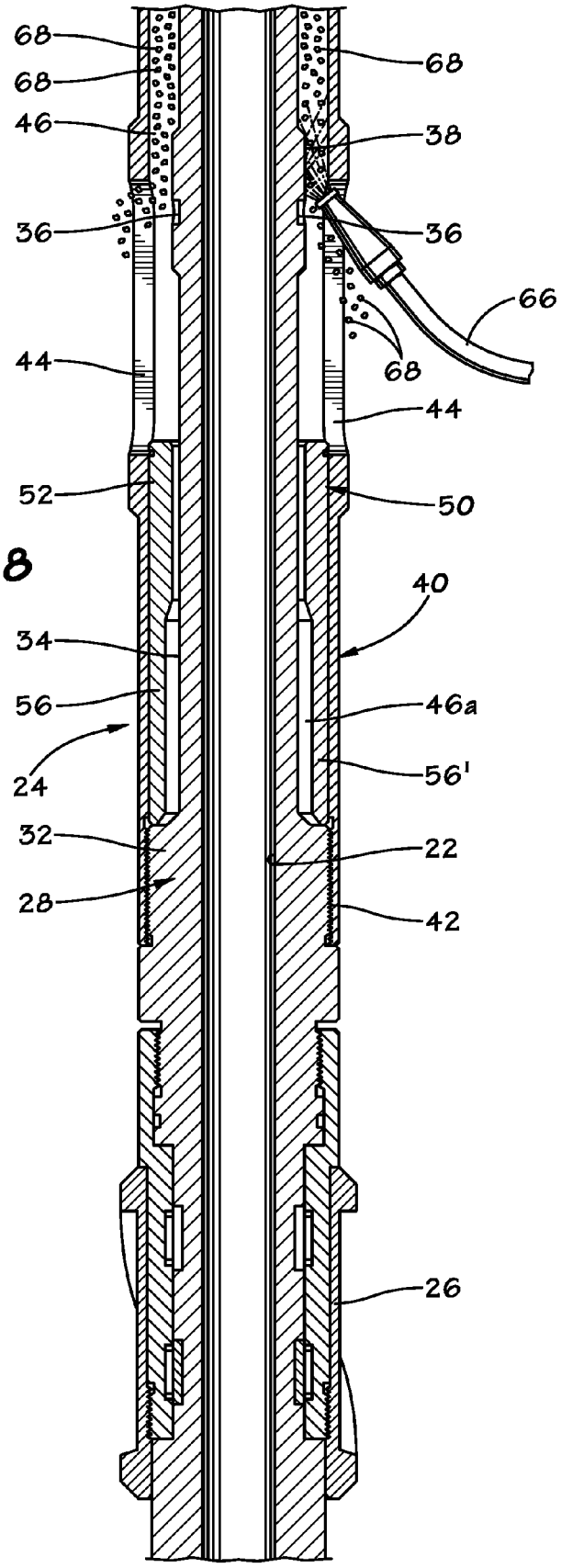
FIG. 8 is a side, cross-sectional view of the cleaning tool shown in FIGS. 1-4, now with the clean-out window in a position associated with cleaning out of the debris chamber.

FIG. 7 depicts the cleanout assembly 24 in a configuration wherein the windows 44 of the boot 40 are not blocked by the blocking portions 56, 56' of the cover 50. In this configuration, the boot 40 has been rotated with respect to the tool body 12 so that the openings 58, 58' of the cover 50 are aligned with the windows 44 of the boot 40. Rotation of the boot 40 also exposes the screws 64 through the windows 44 and permits the screws 64 to be removed from the indentations 36 with a screwdriver or other suitable tool. Once the screws 64 have been removed, the cover 50 can be slid axially within the debris chamber 46. FIG. 8 shows the cover 50 having been moved axially downwardly into the lower chamber **46*a***.

In operation, the cleaning tool 10 is incorporated into a tool string and then disposed into a surrounding tubular to be cleaned in a wellbore. The tool string is reciprocated to allow the brushes of the cleanup assembly 18 to remove debris from the inner surface of the surrounding tubular. During run in and cleaning, the cleanout assembly 24 is in the closed position of FIGS. 2, 3 and 4. Fluid is typically flowed downward through the flow passage 22 of the tool 10 and will exit into the surrounding tubular at some point below the tool 10 and then return flow along the exterior annulus, as is known in the art. As the annular flow encounters the cleanout assembly 24, it is directed through the exterior flow passages 31 to bypass the cleanout assembly 24.

When the cleaning tool 10 is being removed from the surrounding tubular 100, ports 19 on the cleanup assembly 18 are shifted open and fluid carrying removed debris flows through the ports 19 into the debris chamber 46. Fluid is separated from the debris captured within the debris chamber 46 through the filter screen 20.

Upon removal from the surrounding tubular 100, the debris chamber 46 can then be cleaned out, and the amount of debris removed will provide an indication to an operator of the amount of debris present in the tubular. Beginning with the cleanout assembly 24 in the closed configuration shown in FIGS. 2, 3 and 4, the boot 40 is rotated with respect to the tool body 12, to expose the screws 64 through the windows 44. The openings 58, 58' are now aligned with the windows 44 in the boot 40. At this point, any debris that might have entered the lower chamber **46*a* can be removed. The screws 64 are then removed from the indentations 36 to free the cover 50 from the mandrel 28**.

Thereafter, the cover 50 may be slid axially downwardly into the lower chamber **46*a*. In this position, the windows 44 are open to permit access to the debris chamber 46. This allows the debris chamber 46 above the cover 50 to be cleaned out using water sprayed by hose 66** or other tools.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A cleanout assembly for removal of debris from a cleaning tool, the cleanout assembly comprising:

a mandrel;

a boot radially surrounding the mandrel;

a debris chamber defined radially between the mandrel and the boot;

the boot having one or more side windows radially disposed therein to permit debris to be removed from the debris chamber; and a cover disposed within the debris chamber and being movable within the debris chamber between a first position, wherein the one or more windows are blocked by the cover, and a second position, wherein the one or more windows are not blocked by the cover.

2. The cleanout assembly of claim 1 wherein the cover is moved axially within the debris chamber from the first position to the second position.

3. The cleanout assembly of claim 1 wherein the cover comprises:

an annular ring portion; and a plurality of blocking portions that extend axially from the ring portion and which are radially separated from one another by openings and which block the one or more side windows when the cover is in the first position.

4. The cleanout assembly of claim 1 wherein the cover is selectively securable to the mandrel by a fastener.

5. The cleanout assembly of claim 1 wherein there are two windows.

6. The cleanout assembly of claim 1 wherein:

the boot presents an outer diameter; and an external fluid flow path is formed in the outer diameter.

7. A tool for cleaning a radially surrounding tubular member, the tool comprising:

a tool body;

a cleaning member carried on the tool body for removal of debris from the surrounding tubular member;

a cleanout assembly carried on the tool body and comprising:

a) a mandrel that is incorporated into the tool body;

b) a boot radially surrounding the mandrel;

c) a debris chamber defined radially between the mandrel and the boot;

d) the boot having one or more side windows radially disposed therein to permit debris to be removed from the debris chamber; and e) a cover disposed within the debris chamber and being movable within the debris chamber between a first position, wherein the one or more windows are blocked by the cover, and a second position, wherein the one or more windows are not blocked by the cover.

8. The tool of claim 7 wherein the cover is moved axially within the debris chamber from the first position to the second position.

9. The tool of claim 7 wherein the cover comprises:

an annular ring portion; and a plurality of blocking portions that extend axially from the ring portion and which are radially separated from one another by openings and which block the one or more side windows when the cover is in the first position.

10. The tool of claim 7 wherein the cover is selectively securable to the mandrel by a fastener.

11. The tool of claim 7 wherein there are two windows.

12. The tool of claim 7 wherein:

the boot presents an outer diameter that approximates drift diameter; and an external fluid flow path is formed in the outer diameter.

13. A method of removing debris from a debris chamber defined between a mandrel and a boot of a cleaning tool, the method comprising the steps of:

moving a cover within the debris chamber to unblock a side window radially disposed in the boot;

removing debris accumulated within the debris chamber through the window.

14. The method of claim 13 further comprising the step of detaching the cover from the mandrel prior to moving the cover.

15. The method of claim 14 wherein the cover detached by loosening set screws.

16. The method of claim 13 wherein the debris is removed by spraying water into the debris chamber.

17. The method of claim 13 wherein the cover is moved axially within the debris chamber to allow debris to travel through the window in the boot.

18. The method of claim 13 wherein:

the cover comprises an annular ring portion and a plurality of blocking portions that extend axially from the ring portion and which are radially separated from one another by openings; and wherein rotating the boot aligns one of the openings with the window in the boot.

19. The method of claim 18 wherein there are two windows and two openings.

* * * * *

UNITED STATES PATENT AND TRADEMARK OFFICE

CERTIFICATE OF CORRECTION

PATENT NO. : 8,387,700 B2
APPLICATION NO. : 12/789914
DATED : March 5, 2013
INVENTOR(S) : Gregory L. Hern It is certified that error appears in the above-identified patent and that said Letters Patent is hereby corrected as shown below:

In the Specifications:

At column 6, line 23, the phrase "the cover detached" should be -- the cover is detached --.

Signed and Sealed this
Sixteenth Day of April, 2013

Teresa Stanek Rea
*Acting Director of the United States Patent and Trademark Office*